US009951464B2

(12) United States Patent
Lee et al.

(10) Patent No.: US 9,951,464 B2
(45) **Date of Patent: *Apr. 24, 2018**

(54) CLOTHES DRYER

(71) Applicant: LG ELECTRONICS INC., Seoul (KR)

(72) Inventors: Manseok Lee, Seoul (KR); Haeyoon Je, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/211,520

(22) Filed: Jul. 15, 2016

(65) Prior Publication Data

US 2017/0016172 A1 Jan. 19, 2017
US 2017/0362769 A9 Dec. 21, 2017

(30) Foreign Application Priority Data

Jul. 17, 2015 (KR) ..... 10-2015-0102000

(51) Int. Cl.
*D06F 58/22* (2006.01)
*D06F 58/02* (2006.01)
*D06F 58/20* (2006.01)

(52) U.S. Cl.
CPC ..... *D06F 58/22* (2013.01); *D06F 58/02* (2013.01); *D06F 58/206* (2013.01); *D06F 58/20* (2013.01)

(58) Field of Classification Search
CPC ..... D06F 58/22; D06F 58/02; D06F 58/20; D06F 58/206

(Continued)

(56) References Cited

U.S. PATENT DOCUMENTS 3,748,746 A * 7/1973 Robandt ..... D06F 58/22 34/82
5,651,188 A * 7/1997 Swanson ..... D06F 58/22 34/595

(Continued)

FOREIGN PATENT DOCUMENTS

EP 1650344 A2 * 4/2006 ..... D06F 58/22
EP 3118366 A1 * 1/2017 ..... D06F 58/02

(Continued)

OTHER PUBLICATIONS

European Search Report dated Sep. 16, 2016 issued in Application No. 16179667.7.

(Continued)

*Primary Examiner* — Stephen M Gravini
(74) *Attorney, Agent, or Firm* — Ked & Associates, LLP

(57) ABSTRACT

A clothes dryer includes a rotatable drum, a drum supporter for supporting the drum, the drum supporter being provided with a discharge port for discharging air from the drum, a circulation channel for guiding air discharged through the discharge port into the drum, and a filter cartridge for filtering air in the circulation channel, wherein the filter cartridge includes an inside filter cartridge for filtering air discharged from the drum and an outside filter cartridge disposed in the circulation channel in a state of being supported by the drum supporter, the outside filter cartridge including a front filter for filtering air that passes through the inside filter cartridge and flows forward, a rear filter for filtering air that passes through the inside filter cartridge and flows rearward, and a lateral filter for filtering air that passes through the inside filter cartridge and flows in the lateral direction.

20 Claims, 12 Drawing Sheets

(58) Field of Classification Search
USPC ..... 34/595–610
See application file for complete search history.

(56) References Cited

U.S. PATENT DOCUMENTS

| | | | | |
|---|---|---|---|---|
| 7,020,985 | B2 * | 4/2006 | Casey | D06F 58/206 34/595 |
| 7,325,332 | B2 * | 2/2008 | Chung | D06F 58/22 34/602 |
| 7,921,578 | B2 * | 4/2011 | McAllister | D06F 35/00 134/10 |
| 7,987,616 | B2 * | 8/2011 | Bae | D06F 58/04 134/130 |
| 8,181,359 | B2 * | 5/2012 | Bae | D06F 58/04 134/22.12 |
| 8,365,438 | B2 * | 2/2013 | Choi | D06F 58/20 34/260 |
| 8,615,895 | B2 * | 12/2013 | Shin | D06F 58/22 34/606 |
| 8,667,705 | B2 * | 3/2014 | Shin | D06F 58/22 34/595 |
| 8,695,232 | B2 * | 4/2014 | Choi | D06F 39/008 34/597 |
| 9,228,293 | B2 * | 1/2016 | Yeom | D06F 58/04 |
| 9,435,070 | B2 * | 9/2016 | Bae | D06F 58/28 |
| 2012/0144687 | A1 | 6/2012 | Yeom | |
| 2015/0247279 | A1 * | 9/2015 | Bison | D06F 58/22 34/82 |
| 2017/0016171 | A1 * | 1/2017 | Lee | D06F 58/02 |
| 2017/0016172 | A1 * | 1/2017 | Lee | D06F 58/02 |

FOREIGN PATENT DOCUMENTS

| | | | | |
|---|---|---|---|---|
| GB | 809944 | | 3/1959 | |
| JP | 2016107025 | A * | 6/2016 | |
| KR | 20-0177344 | | 4/2000 | |
| KR | 10-0664507 | | 1/2007 | |
| KR | 10-0737320 | | 7/2007 | |
| KR | 10-2011-0122465 | | 11/2011 | |
| KR | 10-1081091 | | 11/2011 | |
| KR | 20120066549 | A * | 6/2012 | D06F 58/04 |
| WO | WO 2015/007572 | | 1/2015 | |

OTHER PUBLICATIONS

International Search Report dated Nov. 3, 2016 issued in Application No. PCT/KR/2016/007713.

* cited by examiner

CLOTHES DRYER

CROSS-REFERENCE TO RELATED APPLICATION

This application claims priority benefit under 35 U.S.C. § 119 to Korean Application No. 10-2015-0102000, filed on Jul. 17, 2015, whose entire disclosure is hereby incorporated by reference.

BACKGROUND

1. Field

The present disclosure relates to a clothes dryer.

2. Background

A clothes dryer is an apparatus that supplies dry air into a drum in which clothes are placed in order to dry the clothes. The clothes dryer may be classified as an exhaust type clothes dryer that exhausts air discharged from a drum out of the clothes dryer or a circulation type clothes dryer that circulates air discharged from a drum and resupplies the circulated air into the drum.

In the circulation type clothes dryer, a filter cartridge is provided in a circulation channel in order to prevent foreign matter, such as lint or dust, floating in the air discharged from the drum from being introduced into the drum again. The filter cartridge is configured so as to be separable from the clothes dryer such that a user separates the filter cartridge from the clothes dryer and removes foreign matter from the filter cartridge.

The filter cartridge may be configured to have a dual filter structure in which an inside filter cartridge is received in an outside filter cartridge such that air passes through the inside filter cartridge, by which the air is primarily filtered, and then the air passes through the outside filter cartridge, by which the air is secondarily filtered.

Generally, the inside filter cartridge includes an inside front filter for filtering air that is introduced into the cartridge through an inlet port formed in the top surface thereof and flows forward and an inside rear filter for filtering air that is introduced into the cartridge through the inlet port and flows rearward. In the same manner, the outside filter cartridge includes an outside front filter and an outside rear filter provided at the front surface and the rear surface thereof so as to be aligned with the inside front filter and the inside rear filter, respectively.

In the above structure, however, the filters are provided in the circulation channel in the state in which the filters overlap one another, with the result that the circulation channel may be narrowed. In particular, even if the capacity of the drum is increased, it is difficult to increase the width of the space, in which the filter cartridges are mounted, in the forward and rearward direction. In the conventional structure in which the inside and outside filters are sequentially arranged in the forward and rearward direction, therefore, a stream of air may not smoothly pass through the filters.

BRIEF DESCRIPTION OF THE DRAWINGS

The embodiments will be described in detail with reference to the following drawings in which like reference numerals refer to like elements wherein.

DETAILED DESCRIPTION OF THE PREFERRED EMBODIMENTS

Figure 1:
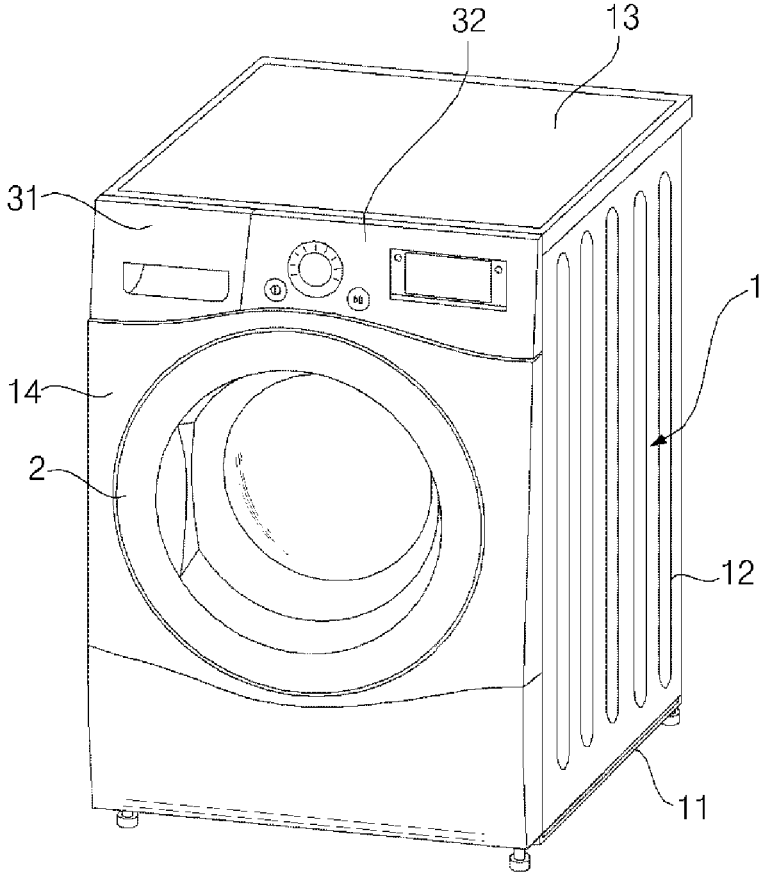
FIG. 1 is a perspective view showing the external appearance of a clothes dryer according to an embodiment of the present disclosure.

Advantages and features of the present disclosure and a method of achieving the same will be more clearly understood from embodiments described below with reference to the accompanying drawings. However, the present disclosure is not limited to the following embodiments but may be implemented in various different forms. The embodiments are provided merely to complete disclosure of the present disclosure and to fully provide a person having ordinary skill in the art to which the present disclosure pertains with the category of the disclosure. The disclosure is defined only by the category of the claims. Wherever possible, the same reference numbers will be used throughout the specification to refer to the same or like elements.

Referring to FIGS. 1 to 4, a clothes dryer according to an embodiment of the present disclosure may include a casing 1 having an opening formed in the front thereof such that clothes can be introduced through the opening, a door 2 for opening and closing the opening, a drum 4 rotatably provided in the casing 1, and a drum supporter 5 for supporting the drum 4.

The casing 1 may include a base 11 placed on the floor on which the clothes dryer is installed, a cabinet 12 supported by the base 11, the cabinet 12 having an open front surface and an open top surface, a top plate 13 disposed on the open top surface of the cabinet 12, and a front cover 14 disposed on the open front surface of the cabinet 12, the front cover 14 having an opening through which laundry is introduced.

The casing 1 may be provided at the upper part of the front surface thereof with a control panel 32, which includes an input unit for allowing various kinds of control commands for controlling the operation of the clothes dryer to be input and a display unit for displaying the state of operation of the clothes dryer.

The clothes dryer may further include a steam supply unit (not shown) for supplying steam into the drum 4. In addition, a water tank for storing water to be supplied to the steam supply unit may be received in a drawer 31.

The drum supporter 5 may be provided with an introduction port 5*a*, through which clothes are introduced into the drum 4. The introduction port 5*a* communicates with the opening in the front cover 14. The drum supporter 5 may be provided with a ring-shaped support surface or a ring-shaped groove for supporting the front end of the drum 4.

The drum supporter 5 may be provided with a discharge port 52*h* for discharging air from the drum 4, and a discharge duct 53 for guiding the air discharged through the discharge port 52*h*. The air discharged from the drum 4 through the discharge port 52*h* is guided along the discharge duct 53, is guided along a connection duct 81, which is connected to the discharge duct 53, and reaches a blowing fan 82. Reference symbol 53*h* shown in FIGS. 3 and 4 indicates the outlet of the discharge duct 53. The connection duct 81 is connected to the outlet of the discharge duct 53.

Figure 3:
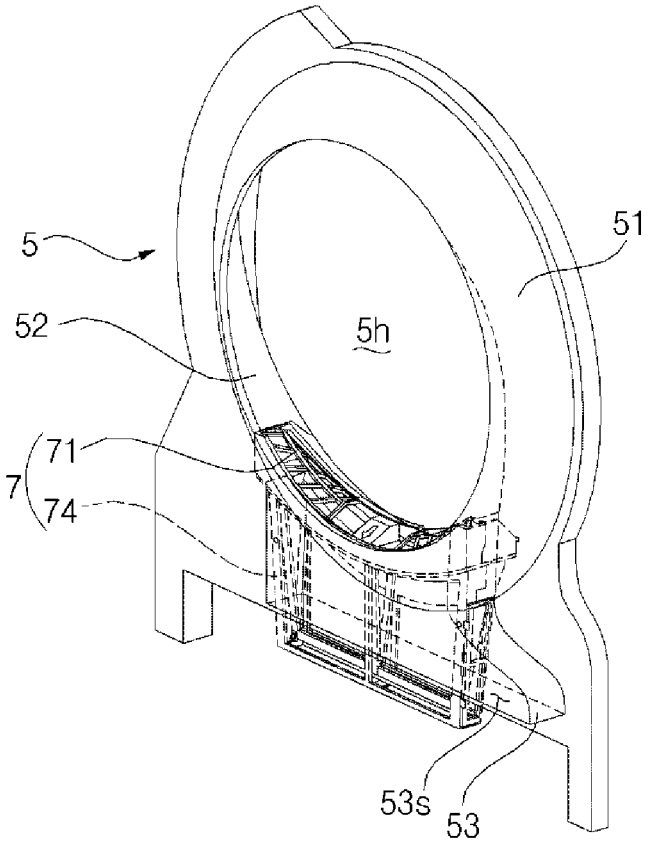
FIG. 3 is a view showing a drum supporter in the state in which a filter cartridge is mounted in the drum supporter.
Figure 4:
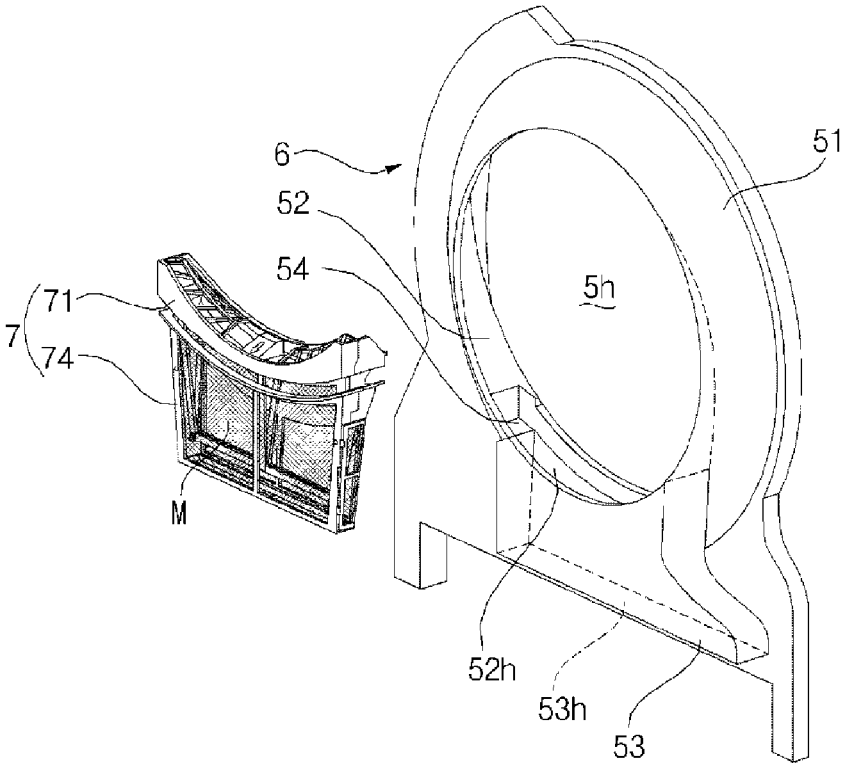
FIG. 4 is a view showing the state in which the filter cartridge is separated from the drum supporter.
Figure 5:
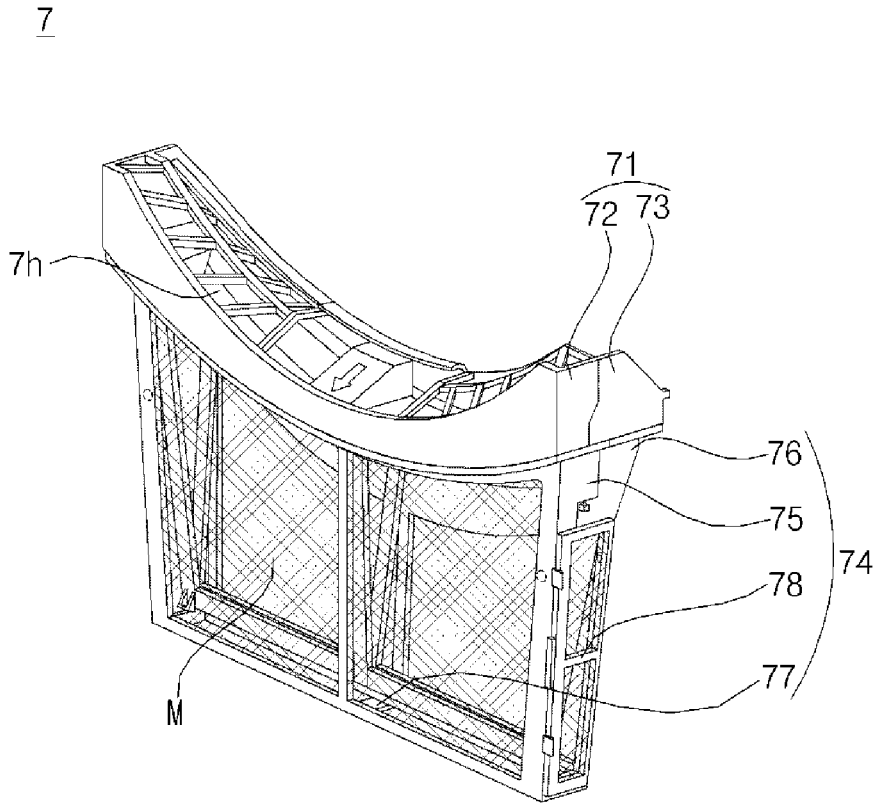
FIG. 5 is a view showing the state in which an inside filter cartridge is received in an outside filter cartridge.

A stream of air that flows in the lateral direction may be formed in the discharge duct 53 depending on the position of the blowing fan 82 or the shape of the discharge duct 53. In this embodiment, as shown in FIGS. 3 and 4, the blowing fan 82 is located so as to be spaced apart from the discharge port 52*h* in the lateral direction. Consequently, the discharge duct 53 includes a section 53*s* for guiding the air discharged through the discharge port 52*h* in the lateral direction.

The drum supporter 5 may include an introduction surface 52, which defines the introduction port 5*h*. The introduction surface 52 may extend from the front surface 51 of the drum supporter 5, in which the introduction port 5*h* is formed, to the drum 4. The introduction surface 52 may constitute a portion of a ring extending around the introduction port 5*h*. The introduction surface 52 may be formed to have a ring shape that wholly defines the introduction port 5*h*. In this embodiment, the introduction surface 52 may be formed to have a shape corresponding to a part in which a filter cartridge 7 is mounted, i.e. a portion of the lower part of the introduction port 5*h*. The discharge port 52*h* is formed in the introduction surface 52 such that the discharge port 52*h* is open upward.

A back panel 6 supports the rear end of the drum 4. The back panel 6 is provided with an air supply port 6*h* for supplying dry air into the drum 4. The back panel 6 may be provided with a ring-shaped support surface or a ring-shaped groove for supporting the rear end of the drum 4.

A motor 83 may be provided to rotate the drum 4. The drum 4 may be driven in a belt drive fashion. In this case, a belt (not shown) wound around the outer circumferential surface of the drum 4 is moved by a pulley (not shown), which is rotated by the motor 83, such that the drum 4 is rotated. A plurality of rollers 55 may be provided at the drum supporter 5 and the back panel 6 so as to support the outer circumferential surface of the drum 4 during the rotation of the drum 4.

The clothes dryer includes a circulation channel for guiding air, discharged from the drum 4 through the discharge port 52*h*, into the drum. The circulation channel includes the discharge duct 53 and the connection duct 81. Although not shown, the circulation channel may further include a channel for guiding the air, blown by the blowing fan 82, to the air supply port 6*h* of the back panel 6. The blowing fan 82 blows air such that the air flows along the circulation channel. In this embodiment, the motor 83, which rotates the drum 4, is also used to rotate the blowing fan 82. Alternatively, an additional motor may be provided to drive the blowing fan 82.

Figure 2:
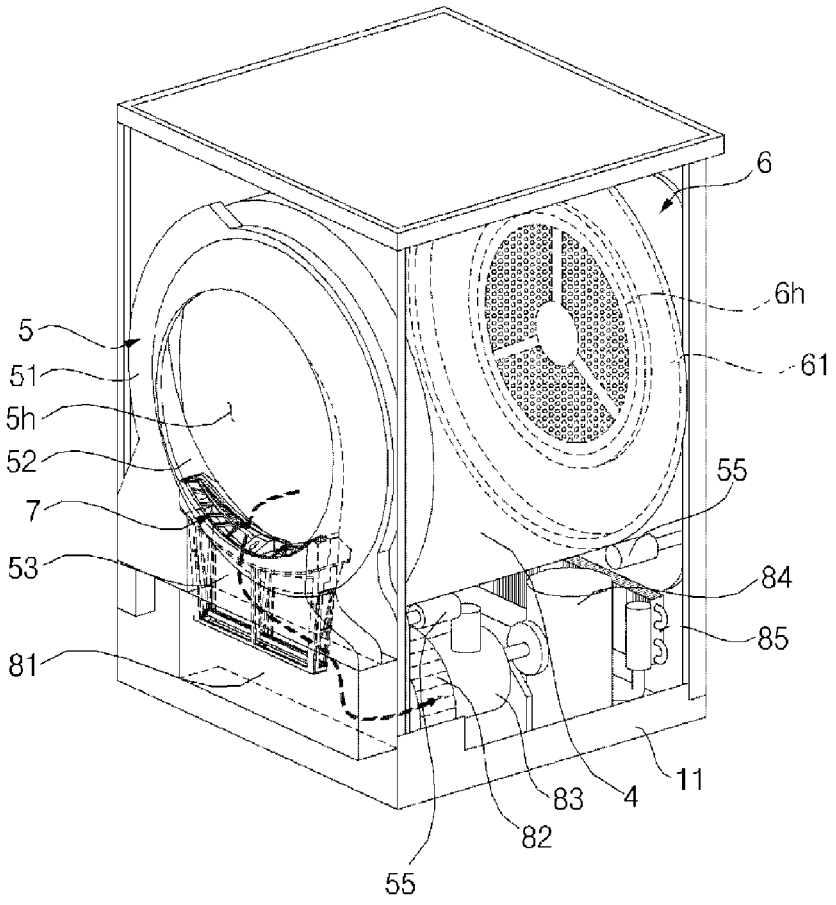
FIG. 2 is a view showing the internal structure of the clothes dryer of FIG. 1.

The clothes dryer may further include a heat generation unit for heating air that flows along the circulation channel. The heat generation unit may be realized by various kinds of well-known means. In this embodiment, the clothes dryer heats air using a heat pump. The heat pump is configured such that a refrigerant is compressed, expanded, evaporated, and condensed while the refrigerant is moved along the closed circulation channel. Heat generated when the refrigerant is condensed is used to heat air. Although a compressor 84 for compressing the refrigerant and a condenser 85 for condensing the refrigerant are shown in FIG. 2, an expansion valve for expanding the refrigerant and an evaporator for evaporating the refrigerant may be further provided. In some embodiments, an electric heater or a thermoelectric device may be used as the heat generation unit.

Referring to FIGS. 3 to 10, a filter cartridge 7 for filtering air is provided in the circulation channel. The filter cartridge 7 is configured to have a dual filter structure including an inside filter cartridge 71 and an outside filter cartridge 74. Air discharged from the drum 4 sequentially passes through the inside filter cartridge 71 and the outside filter cartridge 74, and is then suctioned into the blowing fan 82.

More specifically, the outside filter cartridge 74 is supported by the drum supporter 5 in the state in which the outside filter cartridge 74 is inserted in the discharge port 52*h*. Referring to FIG. 4, the drum supporter 50 may have a location surface 54 defined in the discharge duct 53, and the outside filter cartridge 74 may be located on the location surface 54. Specifically, the upper end of the outside filter cartridge 74 (the bottom surface, which is the surface opposite the top surface 745 shown in FIG. 9A) may be located on the location surface 54. In the state in which the outside filter cartridge 74 is located on the location surface 54, the outside filter cartridge 74 is disposed at a lower position than the introduction surface 52. The outside filter cartridge 74 may be completely received in the discharge duct 53 such that the outside filter cartridge 74 is not exposed through the discharge port 52*h*.

An opening 74*h*, through which the inside filter cartridge 71 passes, is formed in the top surface 745 (see FIG. 9A) of the outside filter cartridge 74. The inside filter cartridge 71 may be received in or separated from the outside filter cartridge 74 through the opening 74*h*.

The inside filter cartridge 71 is configured to have a structure including a mesh M for filtering air and an inside filter frame 710 for fixing the mesh M. The outside filter cartridge 74 is configured to have a structure including a mesh M for filtering air and an outside filter frame 740 for fixing the mesh M. The mesh M may be located at various positions on each of the filter cartridges 71 and 74. In the following description, a mesh located at the front of each of the filter cartridges 71 and 74 will be referred to as a front mesh, a mesh located at the side of each of the filter cartridges 71 and 74 will be referred to as a side mesh, and a mesh located at the rear of each of the filter cartridges 71 and 74 will be referred to as a rear mesh, as needed.

The inside filter cartridge 71 and the outside filter cartridge 74 are separate members. The inside filter cartridge 71 and the outside filter cartridge 74 are mounted in the drum supporter 5 in the state in which the inside filter cartridge 71 is received in the outside filter cartridge 74.

The inside filter cartridge 71 may be provided with an interference protrusion 715. The outside filter cartridge 74 may be provided with a restraint protrusion 745. The restraint protrusion 745 restrains the interference protrusion 715 such that the outside filter cartridge 74 is moved simultaneously with the inside filter cartridge 71 when the inside filter cartridge 71 is pulled in the direction in which the inside filter cartridge 71 is withdrawn through the opening 74*h* in the state in which the outside filter cartridge 74 is supported by the drum supporter 5.

In order to remove foreign matter, such as lint or dust, from the filter cartridge 7, a user may directly remove the filter cartridge 7 from the drum supporter 5. When the inside filter cartridge 71 is withdrawn from the outside filter cartridge 74, the interference protrusion 715 is caught by the restraint protrusion 745, with the result that the interference protrusion 715 is restrained by the restraint protrusion 745, and the inside filter cartridge 71 and the outside filter cartridge 74 are separated from the drum supporter 5 while the inside filter cartridge 71 and the outside filter cartridge 74 are moved simultaneously. Even when the user lifts up only the inside filter cartridge 71 in the state in which the user does not notice the outside filter cartridge 74, therefore, both the inside filter cartridge 71 and the outside filter cartridge 74 may be separated from the drum supporter 5. Consequently, it is possible to fundamentally solve the problem of the outside filter cartridge 74 remaining in the clothes dryer due to the user's carelessness during the removal of foreign matter from the filter cartridge 7 as in the conventional art.

In addition, the inside filter cartridge 71 may not be exposed (i.e. it is not necessary for the user to notice the inside filter cartridge 71) when the filter cartridge 7 is separated from the drum supporter 5 as long as the inside filter cartridge 71 and the outside filter cartridge 74 are connected to each other. Consequently, the inside filter cartridge 71 may be completely mounted in the discharge duct 53.

Meanwhile, the interference protrusion 715 and the restraint protrusion 745 may be spaced apart from each other in the direction in which the inside filter cartridge 71 is moved such that the inside filter cartridge 71 can be moved by a predetermined distance in the outside filter cartridge 74. As shown in FIG. 6A, during the withdrawal of the filter cartridge 7, the inside filter cartridge 71 is moved by a predetermined distance d, and then the interference protrusion 715 interferes with the restraint protrusion 745. As a result, the inside filter cartridge 71 and the outside filter cartridge 74 are simultaneously separated from the drum supporter 5.

The outside filter cartridge 74 includes an outside front filter 75 and an outside rear filter 76, which are connected to each other in an unfoldable or foldable fashion. The outside front filter 75 and the outside rear filter 76 are mounted in the drum supporter 5 in the state in which the outside front filter 75 and the outside rear filter 76 are folded so as to be coupled to each other. In the state in which the outside filter cartridge 74 is separated from the drum supporter 5, the outside front filter 75 and the outside rear filter 76 may be unfolded such that the inside filter cartridge 71 can be pulled out from the outside filter cartridge 74.

According to the circumstances, however, the user may forcibly pull the inside filter cartridge 71 in the state in which the user does not unfold the outside filter cartridge 74. In order to prevent the interference protrusion 715 or the restraint protrusion 745 from breaking even in this case, at least one selected from between the interference protrusion 715 and the restraint protrusion 745 may be provided with a first inclined part 715*a*, the protruding height of which is gradually decreased in the direction in which the inside filter cartridge 71 is separated from the outside filter cartridge 74 (e.g. in the forward direction), and a second inclined part 715*b*, the protruding height of which is gradually decreased in the direction in which the inside filter cartridge 71 is inserted into the outside filter cartridge 74 (e.g. in the downward direction).

In the above structure, even when the inside filter cartridge 71 is pulled in the state in which the outside filter cartridge 74 is not unfolded, the inside filter cartridge 71 may be somewhat deformed due to the characteristics of the material (e.g. the synthetic resin) of the inside filter cartridge 71. When sufficient force is applied to the inside filter cartridge 71, therefore, the first inclined part 715*a* may overcome the interference with the restraint protrusion 745, and may move over the restraint protrusion 745. On the other hand, during the insertion of the inside filter cartridge 71 into the outside filter cartridge 74, the second inclined part 715*b* may overcome the interference with the restraint protrusion 745, and may move over the restraint protrusion 745.

Figure 6:
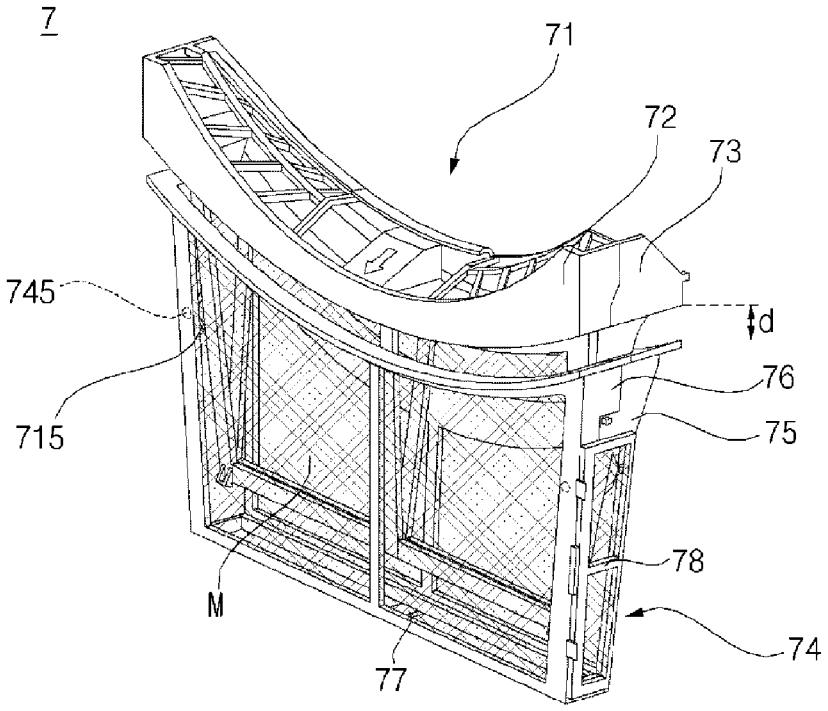
FIG. 6 is a view showing the state in which an interference protrusion of the inside filter cartridge interferes with a restraint protrusion of the outside filter cartridge.
Figure 7:
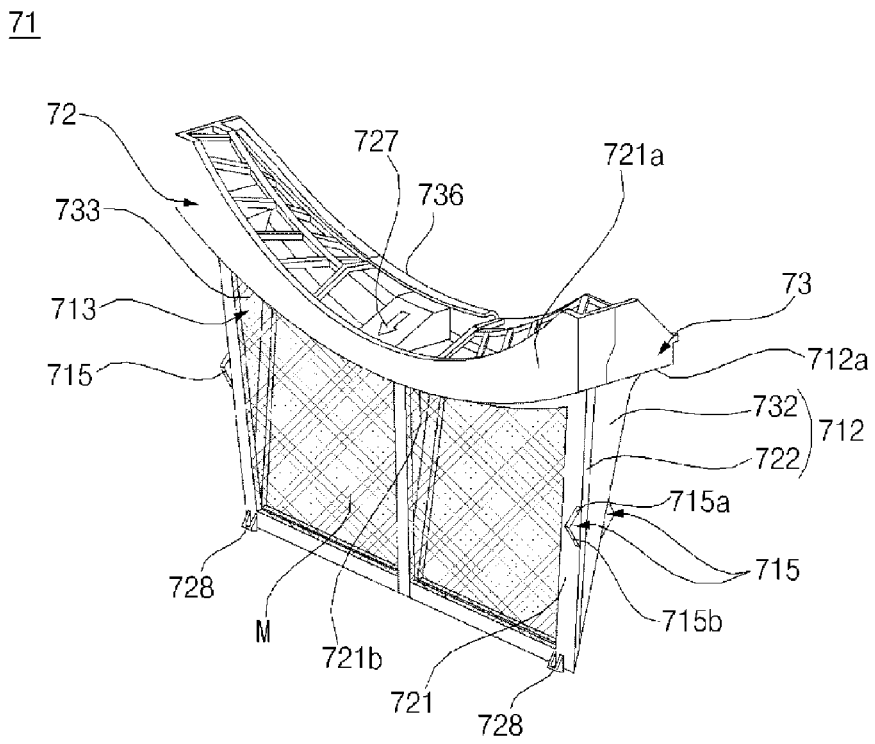
FIG. 7 is a perspective view of the inside filter cartridge.

Referring to FIGS. 6 to 8, the inside filter cartridge 71 includes an inside front filter 72 and an inside rear filter 73, which are connected to each other in an unfoldable or foldable fashion. The inside front filter 72 and the inside rear filter 73 are received in the outside filter cartridge 74 in the state in which the inside front filter 72 and the inside rear filter 73 are folded so as to be coupled to each other.

The inside front filter 72 may include a front surface, on which is mounted a front mesh for filtering air that is introduced through an inlet port formed in the top surface thereof and flows forward. The inside rear filter 73 may include a rear surface, on which is mounted a rear mesh for filtering air that is introduced through the inlet port and flows rearward. The interference protrusion 715 may be formed on at least one selected from between the front surface of the inside front filter 72 and the rear surface of the inside rear filter 73.

Figure 8A:
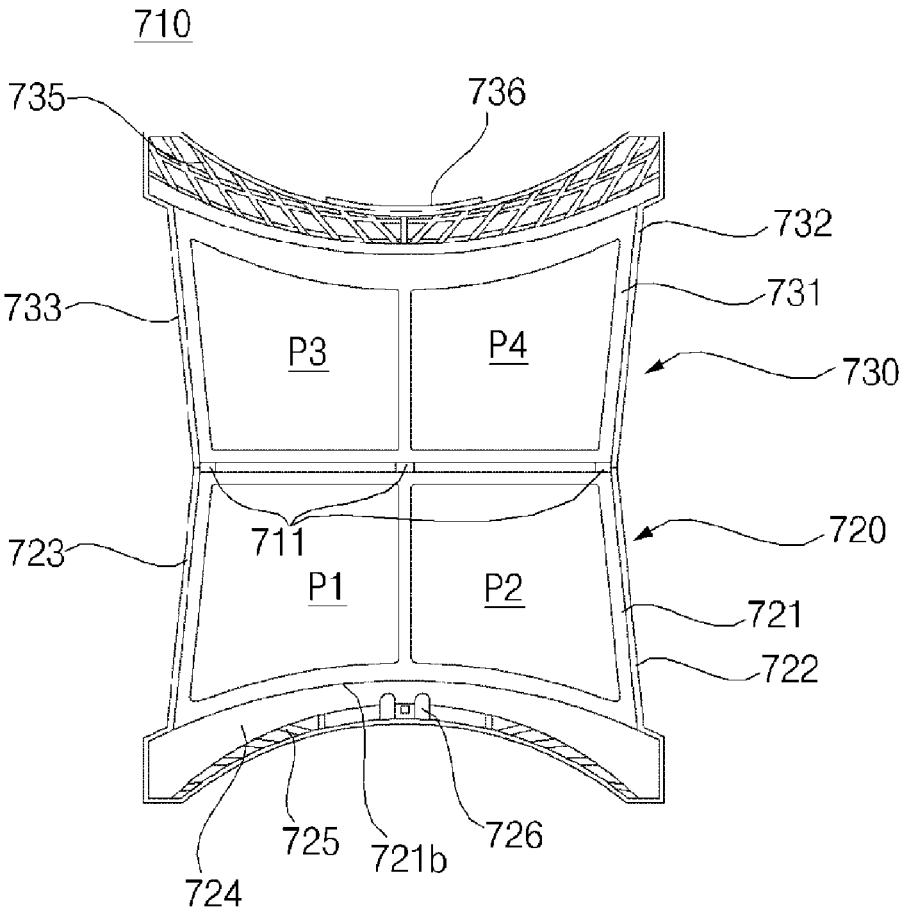
FIG. 8A is a view showing the inside surface of the inside filter cartridge in the state in which the inside filter cartridge is unfolded.
Figure 8B:
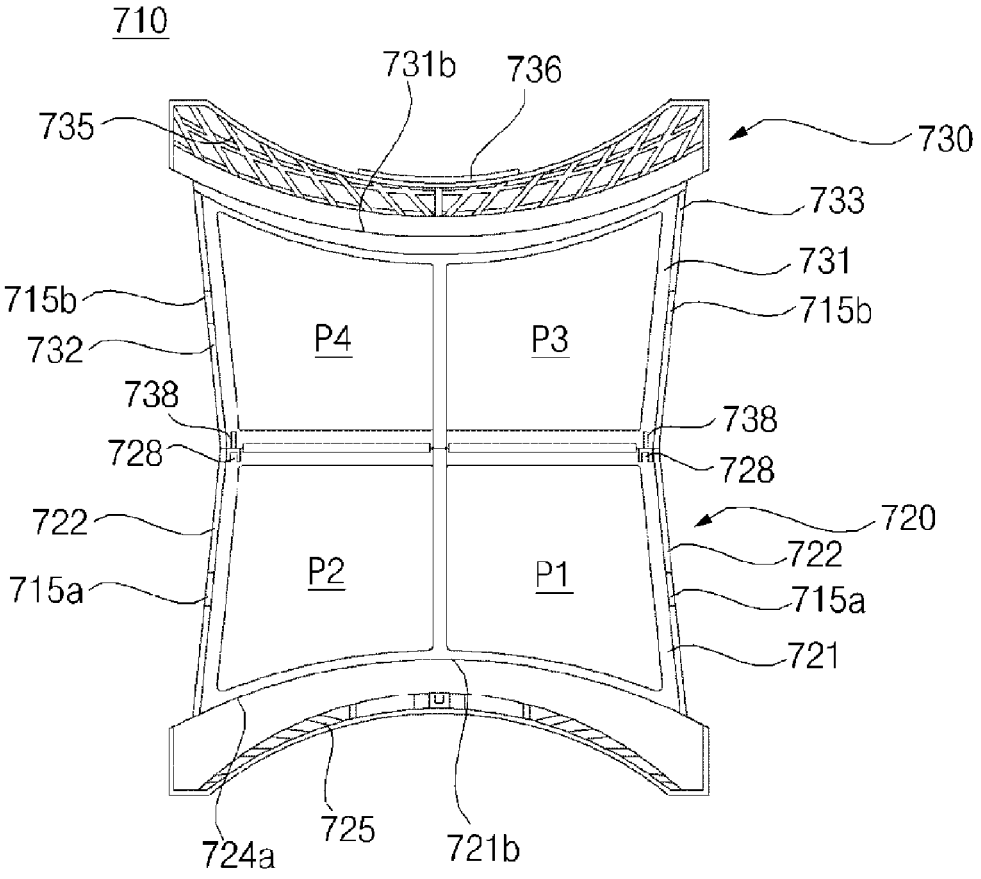
FIG. 8B is a view showing the outside surface of the inside filter cartridge in the state in which the inside filter cartridge is unfolded.

A plurality of interference protrusions 715 may be formed. Referring to FIG. 8B, the interference protrusions 715 may include a first interference protrusion 715*a*, which protrudes forward from the front surface of the inside front filter 72, and a second interference protrusion 715*b*, which protrudes rearward from the rear surface of the inside rear filter 73.

A plurality of restraint protrusions 745 may also be formed. The restraint protrusions 745 may include a first restraint protrusion 745*a*, which protrudes toward the front surface (or an inside front part 721) of the inside front filter 72 so as to correspond to the first interference protrusion 715*a*, and a second restraint protrusion 745*b*, which protrudes toward the rear surface (or an inside rear part 731) of the inside front filter 72 so as to correspond to the second interference protrusion 715*b*.

The inside filter cartridge 71 may have a top surface 745, which is defined by at least one selected from between a top surface 755 of the inside front filter 72 and a top surface 765 of the inside rear filter 73. An inlet port 7*h* (see FIG. 5), through which the air discharged from the drum 4 is introduced, may be formed in the top surface 745.

The top surface of the inside filter cartridge 71 may include lattice ribs 725 and 735 for dividing the inlet port 7*h* into several small regions. The lattice ribs 725 and 735 are advantageous in increasing the rigidity of the inside filter cartridge 71. In addition, the lattice ribs 725 and 735 prevent small objects, such as coins or lighters, from being introduced into the inside filter cartridge 71 even when the small objects are present in the drum 4.

The inside filter cartridge 71 includes a mesh M and an inside filter frame 710 for fixing the mesh M. As shown in FIGS. 8A and 8B, the inside filter cartridge 71 may be made of a synthetic resin, which may be somewhat deformable. The inside filter cartridge 71 may be formed as a single member by injection molding. The inside filter cartridge 71 may have at least one opening P1, P2, P3, and P4, on which the mesh M is mounted.

The top surface of the inside filter cartridge 71 may be configured to have a shape corresponding to the shape of the introduction surface 52, i.e. a curved shape, such as an approximate arc shape. The top surface of the inside filter cartridge 71 and the introduction surface 52 provide a sense of unity, thereby providing an aesthetically pleasing appearance to the inside filter cartridge 71 and reducing interference between the clothes in the drum and the inside filter cartridge 71.

The inside filter frame 710 may include an inside front frame 720 and an inside rear frame 730, which are connected to each other in an unfoldable or foldable fashion. The inside front frame 720 may be provided with openings P1 and P2, on which a front mesh is mounted, and the inside rear frame 730 may be provided with openings P3 and P4, on which a rear mesh is mounted. The inside filter frame 710 may be made of a synthetic resin. The inside front frame 720 and the inside rear frame 730 may be formed as a single member.

The inside front filter 72 includes an inside front frame 720 and a front mesh M, and the inside rear filter 73 includes an inside rear frame 730 and a rear mesh M.

Referring to FIGS. 8A and 8B, the inside filter frame 710 may include an inside front part 721, in which the openings P1 and P2, on which the front mesh is mounted, are formed, an inside rear part 731, in which the openings P3 and P4, on which the rear mesh is mounted, are formed, and a pair of inside lateral parts 712 and 713, which extend from the opposite sides of the inside front part 721 toward the inside rear part 731.

The inside front part 721 may be formed at the inside front frame 720, the inside rear part 731 may be formed at the inside rear frame 730, and the inside lateral parts 712 and 713 may be formed by at least one selected from between the inside front frame 720 and the inside rear frame 730. For example, the inside lateral part 712 may be formed by a front lateral part 722, which extends rearward from the inside front part 721, and a rear lateral part 732, which extends forward from the inside rear part 731. The inside lateral part 713 may be formed in the same manner as the inside lateral part 712.

Referring to FIG. 7, the upper part 721*a* of the inside front part 721 protrudes further forward than the lower part of the inside front part 721, in which the openings P1 and P2 are formed, so as to define a surface 721*b* that faces downward, and the upper part of the inside rear part 731 protrudes further rearward than the lower part of the inside rear part 731, in which the openings P3 and P4 are formed, so as to define a surface 731*b* that faces downward. The surfaces 721*b* and 731*b* are formed so as to correspond to the top surface 745 (see FIG. 9A) of the outside filter cartridge 74 such that the surfaces 721*b* and 731*b* are located on the top surface 745.

The inside front frame 720 and the inside rear frame 730 may be spaced apart from each other by a predetermined distance. The inside front frame 720 and the inside rear frame 730 may be connected to each other via a connection part 711. A plurality of connection parts 711 may be arranged at intervals. The inside front frame 720 and the inside rear frame 730 may be turned about the connection part 711 such that the inside front frame 720 and the inside rear frame 730 are unfolded or folded.

The inside front filter 72 and the inside rear filter 73 may be separably coupled to each other. Such coupling between the inside front filter 72 and the inside rear filter 73 may be achieved using only the elasticity of the material for the inside front filter 72 and the inside rear filter 73 without an additional fastening member. To this end, a hook 736 may be formed on any one selected from between the inside front frame 720 and the inside rear frame 730, and an appropriate coupling part, to which the hook 736 is coupled, may be formed in the other selected from between the inside front frame 720 and the inside rear frame 730.

A stopper protrusion 728 may be formed on any one selected from between the inside front frame 720 and the inside rear frame 730 such that the stopper protrusion 728 prevents the other selected from between the inside front frame 720 and the inside rear frame 730 from being unfolded at more than a predetermined angle. In addition, a unfolding limit protrusion 738 may be formed on the other selected from between the inside front frame 720 and the inside rear frame 730 such that the unfolding limit protrusion 738 interferes with the stopper protrusion 728 when the other selected from between the inside front frame 720 and the inside rear frame 730 is unfolded at the predetermined angle. As a result, the unfolding angle of the inside filter cartridge 71 is limited so as not to exceed the predetermined angle (for example, 180 degrees), thereby preventing damage to the connection part 711.

The inside filter frame 710 may be provided at the top surface thereof with a mark 727 that indicates the direction in which the inside filter cartridge 71 is mounted. In this embodiment, the mark 727 is formed in the shape of an arrow. The direction indicated by the arrow corresponds to the front of the drum 4.

Figure 9A:
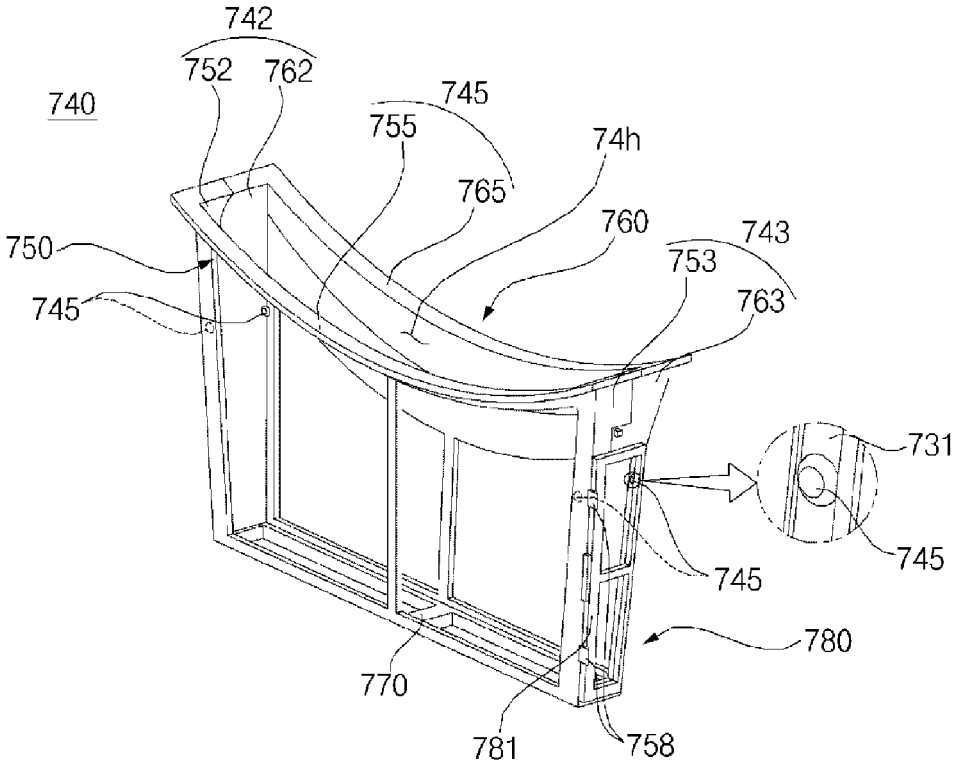
FIGS. 9A and 9B are perspective views of the outside filter cartridge.
Figure 9B:
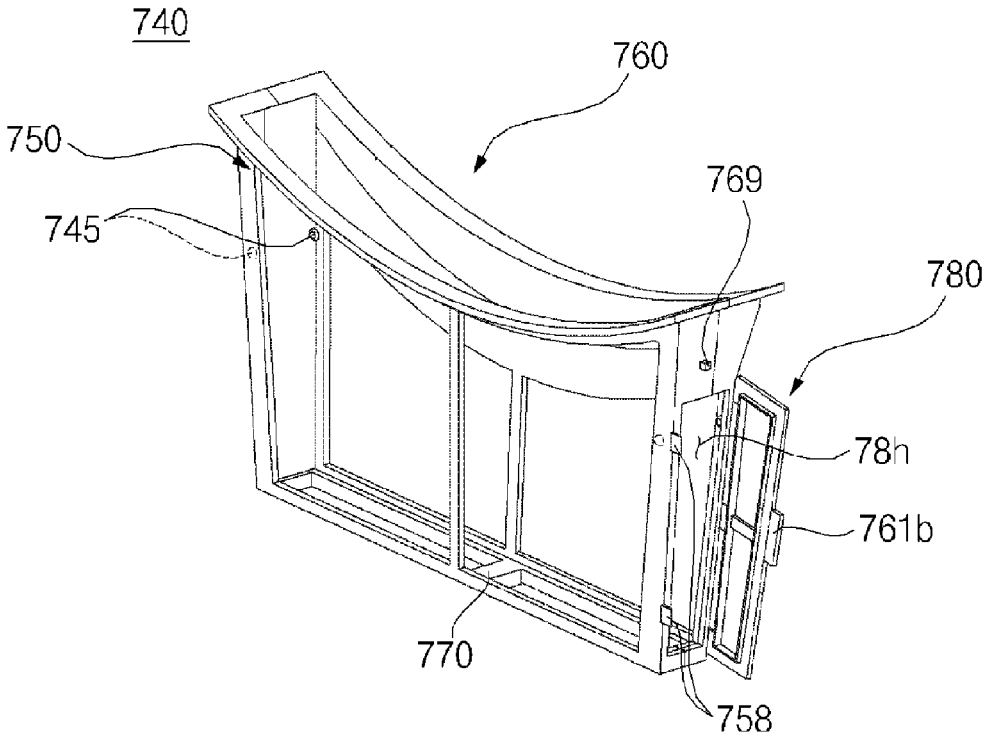
Figure 10:
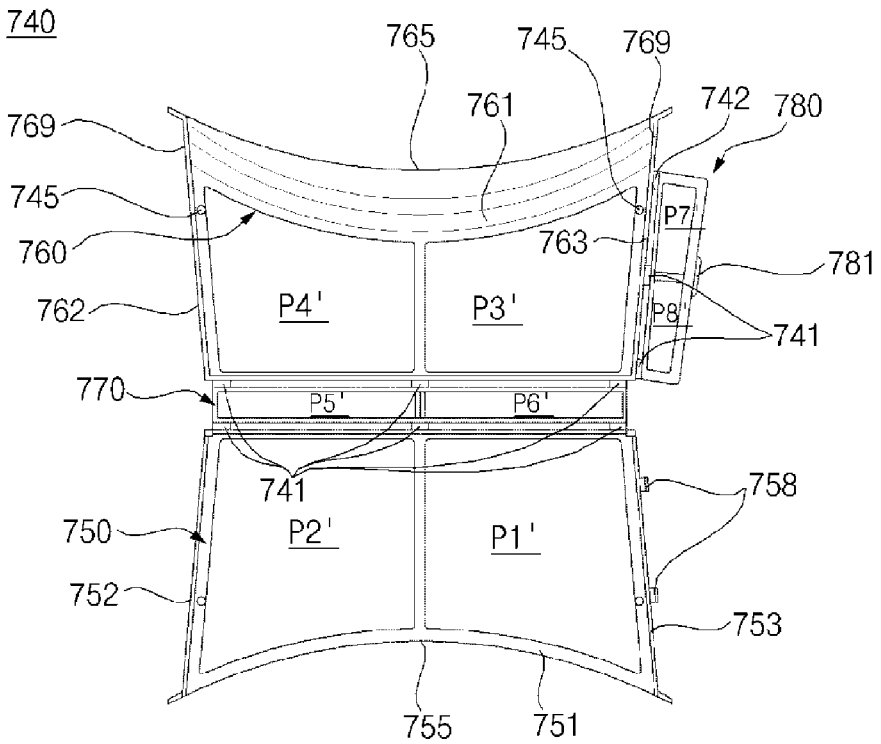
FIG. 10 is a view showing the outside surface of the outside filter cartridge in the state in which the outside filter cartridge is unfolded.

Referring to FIGS. 9A, 9B, and 10, the outside filter cartridge 74 may include an outside front filter 75 for filtering air that passes through the inside filter cartridge 71 and flows forward, an outside rear filter 76 for filtering air that passes through the inside filter cartridge 71 and flows rearward, and a lateral filter 78 for filtering air that passes through the inside filter cartridge 71 and flows in the lateral direction. In particular, since the blowing fan 82 is located so as to be spaced apart from the discharge port 52*h* in the lateral direction, a section for guiding air in the lateral direction is formed in the discharge duct 53. The lateral filter 78 filters air that flows in the lateral direction.

The outside front filter 75, the outside rear filter 76, and the lateral filter 78 may each include a mesh M. The meshes M may be mounted on openings P1', P2', P3', P4', P7', and P8', which are formed in the respective filters 75, 76, and 78.

The lateral filter 78 may be formed in least one of the opposite lateral surfaces of the outside filter cartridge 74. For example, the lateral filter 78 may be formed in one of the lateral surfaces of the outside filter cartridge 74 at which the blowing fan 82 is located, and the other of the lateral surfaces may be closed. Consequently, air that flows toward the blowing fan 82 in the circulation channel passes through the lateral filter 78, by which the air is filtered.

The outside filter cartridge 74 may include a mesh M for filtering air and an outside filter frame 740 for fixing the mesh M. The outside filter frame 740 may include an outside front frame 750, an outside rear frame 760, and a lateral frame 780, which connects the outside front frame 750 and the outside rear frame 760 to each other in an unfoldable or foldable fashion. Referring to FIG. 10, the outside front frame 750 may be provided with openings P1' and P2', on which a front mesh is mounted, the outside rear frame 760 may be provided with openings P3' and P4', on which a rear mesh is mounted, and the lateral frame 780 may be provided with openings P7' and P8', on which a lateral mesh is mounted. The openings P1', P2', P3', and P4' in the outside filter frame 740 correspond to the openings P1, P2, P3, and P4 in the inside filter frame 710, respectively.

The outside front filter 75 includes an outside front frame 750 and a front mesh M, the outside rear filter 76 includes an outside rear frame 760 and a rear mesh M, and the lateral filter 78 includes a lateral frame 780 and a lateral mesh M.

A lateral opening 78*h* is formed between the outside front frame 750 and the outside rear frame 760. The lateral frame 780 is coupled to any one selected from between the outside front frame 750 and the outside rear frame 760, for example the outside rear frame 760, in an unfoldable or foldable fashion, and is coupled to the other selected from between the outside front frame 750 and the outside rear frame 760, for example the outside front frame 750, in the state in which the lateral frame 780 and the outside rear frame 760 are folded. The outside front frame 750, to which the lateral frame 780 is coupled, is provided with a fixing holder 758 for fixing the lateral frame 780. In this embodiment, two fixing holders 758 protrude from the lateral surface of the outside front frame 750 in the lateral direction such that the lateral frame 780 is fixed by the fixing holders 758 in the state in which the opening 78*h* is closed by the lateral frame 780.

The lateral frame 780 may be provided with an opening tab 781. When the opening tab 781 is pulled in the state in which the lateral frame 780 is fixed by the fixing holder 758, the coupling between the lateral frame 780 and the fixing holder 758 is released, and the lateral frame 780 is unfolded. At this time, the uncoupling between the lateral frame 780 and the fixing holder 758 is achieved as the result of elastic deformation of the fixing holder 758, which is made of a synthetic resin material.

Hereinafter, the connection of the lateral frame 780 to the outside rear frame 760 in an unfoldable fashion and the coupling of the lateral frame 780 to the outside front frame 750 in the state of being folded about the connection part 741 will be described by way of example with reference to the accompanying drawings.

The outside filter frame 740 may be made of a synthetic resin. The outside front frame 750, the outside rear frame 760, and a bottom frame 770 and the lateral frame 780, which connect the outside front frame 750 and the outside rear frame 760 to each other, may be formed as a single member. Meanwhile, the connection part 741 (see FIG. 10) for connecting the respective frames 750, 760, 770, and 780, which constitute the outside filter frame 740, to each other in an unfoldable or foldable fashion substantially has the same structure as the connection part 711 for connecting the frames constituting the inside filter frame 710 to each other.

Referring to FIGS. 9 and 10, the outside filter frame 740 may include an outside front part 751, in which the openings P1' and P2', on which the front mesh is mounted, is formed, an outside rear part 761, in which the openings P3' and P4', on which the rear mesh is mounted, is formed, and a pair of outside lateral parts 742 and 743, which extend from the opposite sides of the outside front part 751 toward the outside rear part 761.

The outside front part 751 may be formed at the outside front frame 750, the outside rear part 761 may be formed at the outside rear frame 760, and the outside lateral parts 742 and 743 may be formed by at least one selected from between the outside front frame 750 and the outside rear frame 760. For example, the outside lateral part 743 may be formed by a front lateral part 753, which extends rearward from the outside front part 751, and a rear lateral part 763, which extends forward from the outside rear part 761. The outside lateral part 742 may be formed in the same manner as the outside lateral part 743.

In the state in which the outside filter frame 740 is assembled, the front lateral part 753 and the rear lateral part 763 may partially overlap each other. In the overlapping region, a coupling protrusion 769 may be formed on any one selected from between the front lateral part 753 and the rear lateral part 763, and a coupling recess (not shown), into which the coupling protrusion 769 is inserted, may be formed in the other selected from between the front lateral part 753 and the rear lateral part 763. In the state in which the outside front frame 750 and the outside rear frame 760 are folded, the coupling protrusion 769 is inserted into the coupling recess.

In the state in which the outside filter frame 740 is unfolded, the outside filter frame 740 is assembled as follows. The outside front frame 750 and the outside rear frame 760 are turned upward with respect to the bottom frame 770, and then the outside front frame 750 and the outside rear frame 760 are coupled to each other using the coupling protrusion 769. Subsequently, the lateral frame 780 is turned with respect to the outside rear frame 760, and then the outside front frame 750 and the lateral frame 780 are coupled to each other using the holder 758.

The outside filter cartridge 74 may further include a bottom filter 77 for filtering air that passes through the inside filter cartridge 71 and flows downward. The bottom frame 770 may be provided with openings P5' and P6', on which a bottom mesh M is mounted. In this case, the bottom filter 77 may include the bottom frame 770 and the bottom mesh M.

As is apparent from the above description, the clothes dryer according to the present disclosure includes a filter cartridge configured to have a dual filter structure in which an inside filter cartridge is received in an outside filter cartridge, wherein filters are provided at the front surface, the rear surface, and the lateral surface of the outside filter cartridge. Consequently, the clothes dryer according to the present disclosure has the effect of improving filtering performance.

In particular, the flow of air that passes through the inside filter cartridge and is discharged through the lateral surface of the outside filter cartridge is improved. Consequently, the clothes dryer according to the present disclosure has the effect of achieving the smooth flow of air in a duct (or a channel) having a small width in the forward and rearward direction even when the filter cartridges are disposed in the duct.

In addition, the clothes dryer according to the present disclosure has the effect of improving the flow of air such that the air flows to the blowing fan even in a structure in which the blowing fan is off-center due to the limited space defined in a casing.

It is an object of the present disclosure to provide a clothes dryer including a filter cartridge configured to have a dual filter structure in which an inside filter cartridge is received in an outside filter cartridge, wherein filters are provided at the front surface, the rear surface, and the lateral surface of the outside filter cartridge in order to improve the filtering performance of the outside filter cartridge, and, in particular, to improve the flow of air that passes through the inside filter cartridge and is discharged through the lateral surface of the outside filter cartridge.

It is another object of the present disclosure to provide a clothes dryer including a duct for guiding the flow of air in the lateral direction such that the air flows to a blowing fan even in a structure in which the blowing fan is off-center due to the limited space defined in a casing, wherein a filter cartridge having a lateral filter is mounted in the duct.

It is a further object of the present disclosure to provide a clothes dryer configured to have a structure in which a discharge duct for guiding the air discharged from a drum is provided in front of the drum in order to solve a conventional problem, for example the turbulent flow of air in the discharge duct, caused as the result of the gap between the filters and the inside surface of the discharge duct being further narrowed in a conventional dual filter structure in which the filters are sequentially disposed in the forward and rearward direction in the state in which the width of the discharge duct in the forward and rearward direction is narrow.

In accordance with the present disclosure, the above and other objects can be accomplished by the provision of a clothes dryer including a rotatable drum, a drum supporter for supporting the drum, the drum supporter being provided with a discharge port for discharging air from the drum, a circulation channel for guiding air discharged through the discharge port into the drum, and a filter cartridge for filtering air in the circulation channel, wherein the filter cartridge includes an inside filter cartridge for filtering air discharged from the drum and an outside filter cartridge disposed in the circulation channel in a state of being supported by the drum supporter, the inside filter cartridge being separably received in the outside filter cartridge through an opening formed in the top surface of the outside filter cartridge, the outside filter cartridge including a front filter for filtering air that passes through the inside filter cartridge and flows forward, a rear filter for filtering air that passes through the inside filter cartridge and flows rearward, and a lateral filter for filtering air that passes through the inside filter cartridge and flows in the lateral direction Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clothes dryer comprising:

a rotatable drum;

a drum support to support the drum, the drum support including a discharge port to discharge air from the drum;

a circulation channel to guide, back toward the drum, air discharged through the discharge port; and a filter cartridge to filter air in the circulation channel, wherein the filter cartridge comprises:

an inside filter cartridge to filter air discharged from the drum; and an outside filter cartridge provided in the circulation channel when the outside filter cartridge is supported by the drum support, the outside filter cartridge having a front filter to filter air that passes through the inside filter cartridge and flows forward, a rear filter to filter air that passes through the inside filter cartridge and flows rearward, and a lateral filter to filter air that passes through the inside filter cartridge and flows in a lateral direction.

2. The clothes dryer according to claim 1, wherein the lateral filter is provided in a section of the circulation channel that guides air in the lateral direction.

3. The clothes dryer according to claim 1, further comprising:

a blowing fan to blow air through the circulation channel, wherein the blowing fan is spaced apart from the filter cartridge in the lateral direction, the drum support comprises a discharge duct to guide the air discharged through the discharge port in the lateral direction such that the air flows to the blowing fan, and the lateral filter is provided in the discharge duct.

4. The clothes dryer according to claim 3, wherein the lateral filter is included in at least one of opposing lateral surfaces located between the front filter and the rear filter.

5. The clothes dryer according to claim 4, wherein the lateral filter is located in one of the opposing lateral surfaces corresponding to a location of the blowing fan.

6. The clothes dryer according to claim 5, wherein the other lateral surface is closed such that air does not flow through the other lateral surface.

7. The clothes dryer according to claim 1, wherein the inside filter cartridge comprises a front filter and a rear filter corresponding to the front filter and the rear filter of the outside filter cartridge, respectively.

8. The clothes dryer according to claim 1, wherein the outside filter cartridge comprises:

at least one mesh for filtering air; and a filter frame to which the at least one mesh is affixed, the filter frame including a front frame constituting the front filter, a rear frame constituting the rear filter, a bottom frame connected between the front filter and the rear filter, and a lateral frame constituting the lateral filter, the front frame, the rear frame, the bottom frame, and the lateral frame being formed as a single member made of a synthetic resin.

9. The clothes dryer according to claim 8, wherein the front frame and the rear frame are connected to the bottom frame in a foldable fashion, and the lateral frame is hingedly connected to one of the front frame and or the rear frame in a foldable fashion.

10. The clothes dryer according to claim 9, wherein the lateral frame is separably coupled to another one of the front frame or the rear frame.

11. The clothes dryer according to claim 10, wherein the other one of the front frame or the rear frame includes a fixing holder configured to be separably coupled to the lateral frame.

12. The clothes dryer according to claim 9, wherein:

the filter frame has an opening formed in a lateral surface thereof, and the lateral frame is connected to one of the front frame or the rear frame so as to selectively close the opening.

13. The clothes dryer according to claim 8, wherein the bottom frame is coupled to a mesh to filter air that passes through the inside filter cartridge and flows downward.

14. The clothes dryer according to claim 1, wherein the inside filter cartridge is provided with an interference protrusion, and the outside filter cartridge is provided with a restraint protrusion that engages the the interference protrusion such that the outside filter cartridge is removed from the drum support when a pulling force is applied to the inside filter cartridge to withdraw the inside filter cartridge from the opening in the outside filter cartridge.

15. The clothes dryer according to claim 10, wherein the lateral frame includes an opening tab that provides a handling surface for a user to selectively release the lateral frame from the other one of the front frame or the rear frame.

16. The clothes dryer according to claim 8, wherein one of the front frame or the rear frame includes a coupling protrusion, and another one of the front frame or the rear frame includes a coupling recess to receive the coupling protrusion to couple the front frame and the rear frame.

17. The clothes dryer according to claim 8, wherein a top surface of the inside filter cartridge mates with a top surface of the outside filter cartridge to prevent the air discharged from the drum from being introduced into the outside filter cartridge without first passing through the inside filter cartridge.

18. The clothes dryer according to claim 8, wherein the filter frame includes one or more connection parts that connect the bottom frame to the front frame and the back frame and the lateral frame to at least one of the front frame or the rear frame.

19. The clothes dryer according to claim 1, wherein the inside filter cartridge is removable from the outside filter cartridge.

20. The clothes dryer according to claim 1, wherein the inside filter cartridge is inserted into the outside filter cartridge through an opening formed in a top surface of the outside filter cartridge.

* * * * *